United States Patent [19]

Gwin

[11] 4,245,271

[45] Jan. 13, 1981

[54] CRANE SYSTEM OR CARGO CONTAINERS

[76] Inventor: Steve W. Gwin, 1177 Alberdan Cir., Pinole, Calif. 94564

[21] Appl. No.: 40,137

[22] Filed: May 18, 1979

[51] Int. Cl.[3] ..... B66C 1/00; H01H 47/00

[52] U.S. Cl. ..... 361/189; 361/179; 361/192; 294/81 SF

[58] Field of Search ..... 361/179, 189, 192, 194; 294/81 SF

[56] References Cited

U.S. PATENT DOCUMENTS

| | | | |
|---|---|---|---|
| 3,858,728 | 1/1975 | Fathauer | 294/81 SF |
| 3,885,676 | 5/1975 | Wilson et al. | 294/81 SF |
| 3,888,536 | 6/1975 | Durenec | 294/81 SF |

*Primary Examiner*—Harry E. Moose, Jr.
*Assistant Examiner*—L. C. Schroeder
*Attorney, Agent, or Firm*—Phillips, Moore, Weissenberger, Lempio & Majestic

[57] ABSTRACT

In a crane system for moving a cargo container, an improved system for maintaining the container in a locked relation against a spreader assembly having a plurality of proximity sensors which initially control the ability of said system to lock the container to said spreader, includes a relay connected so as to be actuated by the initial coupling of power to the locking solenoid, such relay acting to maintain power to the locking solenoid even if one or more of the proximity sensors subsequently changes state. The system further includes another relay operatively connected to restore the system to an operative condition after a loss of power has been experienced, such relay functioning to restore power to the locking or unlocking portion of the system, once power has been reestablished, independent of the state of the proximity sensors.

10 Claims, 4 Drawing Figures

CRANE SYSTEM OR CARGO CONTAINERS

BACKGROUND OF THE INVENTION

The present invention pertains generally to systems for controlling the locking and unlocking of a crane spreader assembly onto a container to be moved by the crane. More particularly, the present invention relates to a system whereby power is maintained to the locking or unlocking device after it is once actuated, independent of the subsequent state of container proximity sensing switches.

Prior art crane systems for moving cargo containers have provided proximity sensors for detecting when a spreader unit is in place on top of a container. Such sensors have usually been simple mechanical switches which are actuated when contact with a container is obtained, although more recent sensors detect proximity without the need for mechanical contact for switch closure. Locking of the spreader unit to the container is allowed only when all sensors are indicating that the spreader is in place with respect to the container. If one or more of these proximity sensors is not properly actuated to indicate that a container is in place, power is not allowed to be transferred to the locking device. Similarly, the proximity sensors must be all actuated to allow for unlocking of the spreader unit from the container. The difficulty with such systems is that once the crane has begun to lift the container, one or more of the proximity sensors will cease to be actuated, due to relative movement of the spreader with respect to the container. This movement inherently results from the massive locking structure required to transport the weight of a loaded container. In other words, although the spreader must be in intimate relation with the container to insure effective operation of the locking device, when the container is lifted, its weight as well as the necessary tolerance and natural wear of the locking device will result in a limited separation of the container from the spreader. Applicant has found that it is impractical, if not impossible, to design a system in which the proximity sensors are capable of both sensing the intimate relation necessary for effective locking of the spreader to the container and remaining actuated when the container is being transported by the spreader. The result according to the prior art, is that power to the locking device is decoupled during transportation of the container by the spreader.

The danger with the above condition is that it allows the solenoid controlled hydraulic valve customarily used to lock the spreader unit against the container to "float". That is, the controlling solenoid is no longer energized to insure that said valve remains in its lock position. Consequently, strong extraneous electromagnetic fields could cause the solenoid and valve to change state, thereby unlocking the container and allowing it to fall from the spreader. Such strong electromagnetic fields are not uncommon, since the valve and locking solenoid are positioned on the spreader unit, and the spreader unit is lowered into the holds of ships where other heavy duty electrical equipment, electrical power cables, degaussing coils, or the like, may be operating.

Thus, applicant has found that in order for the system to be safe, it is necessary to insure that the locking solenoid continues to be maintained in an actuated state, even though one or more of said proximity sensors is no longer actuated. A safe system must also insure that prior to enabling the unlocking function to occur, all of the proximity sensors must again be actuated by lowering the container onto a supporting surface, to reestablish thereby the intimate relation between the spreader and container.

Applicant has discovered that a temporary loss of system power in the crane will disrupt even an otherwise safe system and that means should also be provided for insuring that when power is restored, the system will be returned to an operative condition regardless of the state of the proximity sensors.

SUMMARY OF THE INVENTION

The present invention provides an improved crane system for moving a cargo container. The system includes a spreader means adapted to be positioned on the container to be moved and having a plurality of remotely operated locking members located substantially at the corners of the spreader means for engaging mating locking devices provided on the container. The spreader means further includes proximity sensors for detecting when the spreader means is properly positioned with respect to the container for locking thereto. The proximity sensors, once proper container position is detected, cause power to be coupled to a manual switch, thereby enabling said manual switch to selectively couple power to either a locking solenoid or an unlocking solenoid, to control thereby, via a hydraulic valve, the locking and unlocking function of the spreader means.

The improvement comprises the addition of a relay which is actuated when the locking solenoid is actuated via said manual switch. Once actuated, this relay acts to create a separate path for coupling power to the manual switch, and thus to the locking solenoid. This relay thus maintains the power coupling even if one or more of the proximity sensors subsequently indicates that the container is not properly positioned with respect to the spreader means. That is, power is maintained to the locking solenoid independent of the state of the proximity sensors once initial proper locking of the spreader means against the container has been completed. Similarly, only when the container is again placed in a resting position after it has been moved, and the proximity sensors are again all indicating proper positioning of the spreader means with respect to the container, is the manual switch enabled to actuate the unlocking solenoid.

The unlocking solenoid also includes a second relay which is connected such that it actuates when the unlocking solenoid is actuated. This second relay thus enables actuation of the unlocking solenoid to also be maintained notwithstanding the subsequent position of the proximity sensing switches.

The improvement of the present invention further includes means, comprising a third relay, for maintaining the status quo of the system even if a temporary power loss is experienced. This enables the continuation, once power has been restored, of the coupling of power to the solenoid previously actuated before power had gone off. In an alternate embodiment, once power has been restored, power is automatically coupled only to the locking solenoid, thereby automatically implementing or, if already in the lock position, maintaining the locked state of the spreader unit.

Therefore, a principal object of the present invention is to provide means for maintaining the locking solenoid in its actuated state, independent of the subsequent state of container proximity sensors, by providing means for the maintaining of power coupling thereto, thereby protecting against the faulty unlocking of a container during transport.

A further object of the present invention is to provide the same protection for the unlocking solenoid when it has been actuated.

A still further object of the present invention is to provide a container locking system wherein the circuit is restored to an operative condition if temporary power failure is experienced.

These and other objects and advantages of the present invention will become more apparent with reference to the following description and the accompanying drawings.

DESCRIPTION OF A PREFERRED EMBODIMENT

Figure 1:
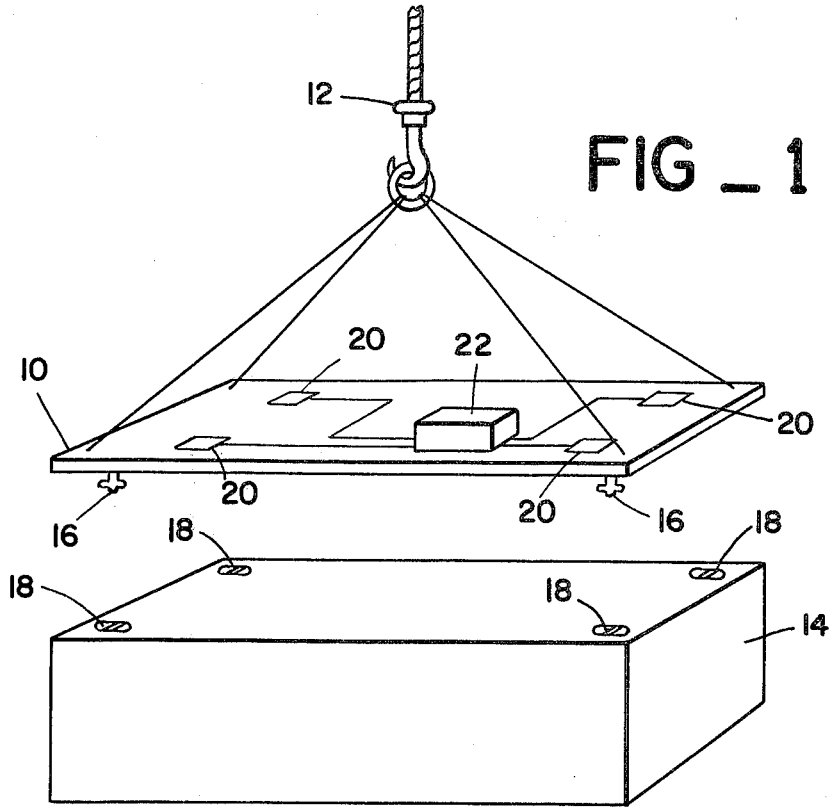
FIG. 1 is a perspective view of a simplified crane system including a spreader unit for moving a cargo container of the type illustrated.

FIG. 1 illustrates a perspective view of a simplified crane system including a spreader unit for moving a cargo container of the type illustrated. The spreader unit is shown at 10, and is carried by a crane via a lower hook portion 12. Hook 12 is shown for purposes of clarity. In practice, the spreader 10 is connected to the crane by an appropriate carriage assembly.

The spreader 10 is designed to be locked onto a container 14 via conventional locking members 16 at the four corners of the spreader unit 10. These locking members 16 are designed to mate with corresponding locking devices 18 positioned on the top of the container 14. The locking devices 18 may comprise slotted wells defined in the surface of container 14 with locking members 16 comprising hydraulically rotatable twist locks. Twisting of the members 16, once they are positioned in respective wells 18, provides the desired locking function.

The spreader unit 10 further includes proximity sensing means for sensing when the spreader unit 10 is in a proper position with respect to the container 14, for locking of the spreader unit 10 thereto. The proximity sensing means includes a plurality of proximity sensors 20, which may be normally open switches adapted to be actuated to their closed state by contact with the container. However, such sensors 20 are preferably of the type which detect the proximity of the container 14 without requiring mechanical contact therewith, thereby enhancing the life of the sensors. For example, in an actual embodiment of this invention, type BERZ-10 proximity switches manufactured by TURK, Inc., 9710 Tenth Avenue, Minneapolis, MN 55441 were used. The electrical output of proximity sensors 20 is coupled to a spreader unit control box 22, which contains relevant portions of the electrical circuitry. Also included in the spreader unit are a pair of solenoids which activate a valve in the hydraulic system which control twisting of locking members 16.

Figure 2:
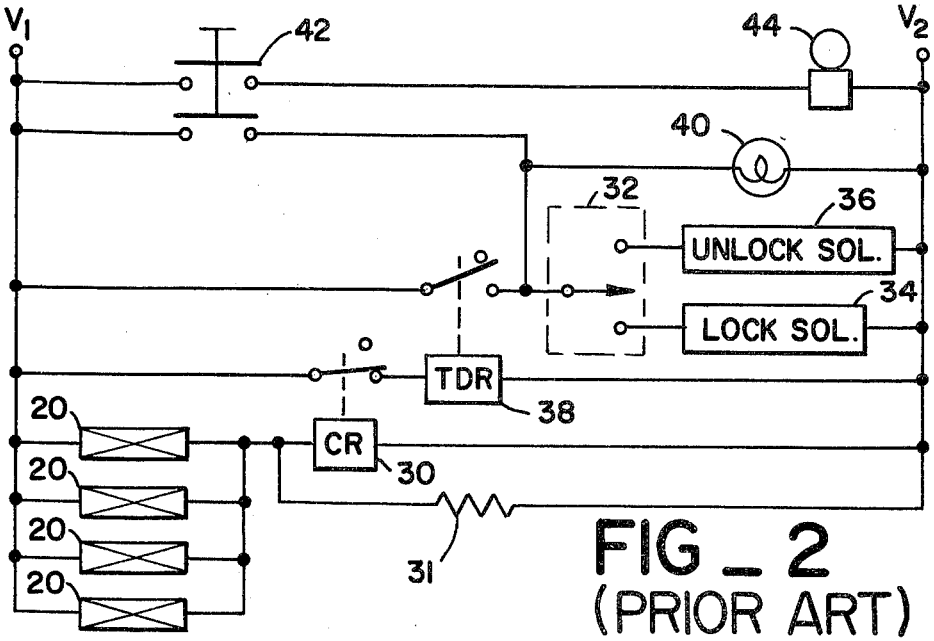
FIG 2 (PRIOR ART)
FIG. 2 is a schematic diagram of an electrical control circuit according to the prior art.

FIG. 2 illustrates a schematic diagram of an electrical control circuit according to the prior art for controlling a spreader unit as shown in FIG. 1. Note that in the following discussion of the circuit of FIG. 2, as well as with FIGS. 3 and 4, all relay contacts are shown in their normal state, i.e., their state when no power is being applied to the circuit. Also, the control circuits of FIGS. 2–4 all include connections $V_1$ and $V_2$ to which a source of control voltage (not shown) is applied in operation.

As seen in FIG. 2, the proximity sensors 20 are preferably connected in parallel, since they comprise semiconductor devices wherein each exhibits a certain voltage drop during normal operation thereof. A series connection of such devices has also been used in the prior art but requires a larger voltage source than is convenient according to the present invention. Furthermore, semiconductor devices usually fail by shorting, rather than burning out. Thus, a defective sensor would provide an inoperative state in parallel but an operative state in series.

The proximity sensors 20 act as normally closed switches which couple power to a control relay 30 until all of the proximity sensors 20 are actuated to an open circuit state. This latter state occurs when proper positioning of the container 14 with respect to the spreader unit 10 is sensed by each sensor 20. When sensors 20 all are open, power is decoupled from control relay 30, allowing its contacts to return to their normally closed position. This causes power to be coupled through a time delay relay 38 to a manual switch 32 which provides means for the selective coupling of power to one of two solenoids 34 and 36. Solenoid 34 is the lock solenoid for actuating the hydraulic valve controlling locking members 16. When actuated thereby, the valve (not shown) causes locking members 16 to lock against the locking devices 18 of container 14. Solenoid 36 is the unlock solenoid, which causes said valve to be actuated in an opposite direction. When actuated in this direction, the valve causes the locking members 16 to unlock from container 14.

Thus, when control relay 30 goes off, it indicates the existence of proper positioning of spreader 10 on container 14, which indication is needed for the normal operation of the rest of the control circuit. Note that if the proximity sensors 20 were connected in series, they would be of the normally open type and the control relay 30 would have normally open contacts to enable normal circuit operation, i.e., the coupling of power to manual switch 32 as described above, when all sensors are actuated to a closed circuit state. In this case, the control relay 30 would be caused to go on to close its contacts in response thereto.

Further, note that where sensors 20 are connected in parallel, resistor 31 is needed to shunt excess current past relay 30, since in their open state, each sensor, being a semiconductor device, still allows a small amount of current to pass.

To insure that the spreader unit 10 is not just momentarily properly positioned on container 14, the time delay relay 38 is interposed between control relay 30 and the rest of the control circuit, to delay the coupling of power thereto until a set length of time has elapsed without any change in the state of a sensor 20, and with control relay 30 in its off state. Such means for delaying the actuation of control circuits is a common and wellknown method of insuring that the massive mechanical elements of the crane are at rest before such actuation occurs.

To summarize the above, power is coupled to the manual switch 32 when time delay relay 38 is actuated. Time delay relay 38 is not actuated until control relay 30 is caused to have power decoupled therefrom. This occurs when a plurality of proximity sensors 20 all are in an open circuit state, indicating the proper positioning of spreader 10 with respect to a container 14. As can be seen, when power is coupled to the manual switch 32, the crane operator is enabled to either actuate the lock solenoid 34 or the unlock solenoid 36.

Most prior art crane systems also provide an indicator means 40 to indicate when power is being applied to the manual switch 32, thereby indicating that switch 32 is enabled to couple power to either solenoid 34 or 36. A bypass switch 42 is also usually provided. Such a switch 42 enables the manual generation of an alternate path for the coupling of power to manual switch 32, thereby bypassing the operation of the above described circuitry. A bell 44 or other means may also be provided to provide an audible warning when switch 42 is actuated.

Figure 3:
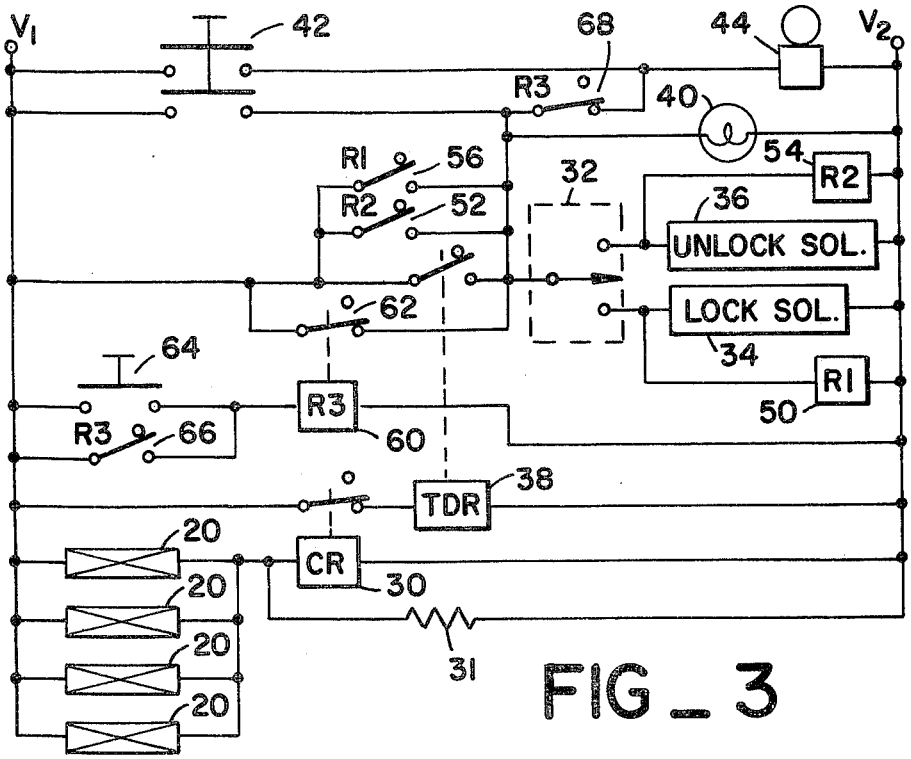
FIG. 3 is a schematic diagram of an electrical control circuit according to the present invention.

Referring now to FIG. 3, an electrical control circuit according to the present invention includes a first relay means, comprising a relay R1, shown at 50. The switch contacts of such first relay 50 are positioned to provide a first separate path 52 for coupling power to the manual switch 32, when relay 50 is in its actuated state, independent of the state of the time delay relay 38. Thus, when the time delay relay 38 enables power to be coupled to manual switch 32, and when manual switch 32 is connected to the lock solenoid 34, first relay 50 is also actuated. This causes power to be maintained to said manual switch 32 independent of the subsequent state of the time delay relay 38. As such, it also acts to maintain power to the lock solenoid 34 independent of the subsequent state of said proximity sensors 20 and control relay 30.

Note, however, that first relay 50 only maintains power to the lock solenoid 34 so long as the manual switch 32 remains connected thereto. Thereafter, either the time delay relay must be in an actuated state for coupling of power to switch 32, or some bypass means must be manually actuated to provide such power, to thereby reactivate the solenoid selected by switch 32 and its associated first or second relay 50, 54.

For clarity, first relay 50 is also indicated as relay R1. This is so that the switch contacts controlled by this relay can also include the same description. The switches of the other relays, described below, will also be marked with similar relay designations. This is needed since it is impossible to position in a clear manner, every set of switch contacts with respect to their corresponding relay.

The control circuit of FIG. 3 also includes a second relay means, comprising a relay R2, shown at 54. Second relay 54 also has switch contacts which are positioned, when relay 54 is in its actuated state, to create a second separate path 56 for coupling power to the manual switch 32 independent of the time delay relay 38. Thus, when the time delay relay 38 enables power to be coupled to manual switch 32 and switch 32 is connected to the unlock solenoid 36, second relay 54 is also actuated, thereby enabling power to be maintained to the manual switch 32 independent of the subsequent state of the time delay relay 38. Thus, as with the condition when the manual switch 32 was connected to actuate the lock solenoid 34, when manual switch 32 is connected to actuate the unlock solenoid 36, relay 54 acts to maintain power to the solenoid 36 independent of the subsequent state of said proximity sensors 20 and control relay 30.

As above with relay 50, however, note that second relay 54 also only maintains power to the unlocking solenoid 36 so long as the manual switch 32 remains connected thereto. Thereafter, either the time delay relay must be in an actuated state for coupling of power to switch 32, or some bypass means must be manually actuated to provide such power, to thereby reactivate the solenoid selected by switch 32 and its associated first or second relay 50, 54.

The present invention further comprises means for maintaining the status quo of the system even if a temporary power loss is experienced. In one embodiment, as seen in FIG. 3, such means includes a third relay means, comprising a relay R3, shown at 60. A set of normally closed switch contacts controlled by said third relay 60 are positioned to provide a third separate path 62, for coupling power to said manual switch 32 when relay 60 is in its unactuated state. Thus, when a power loss has occurred, or during the initial startup of the crane system according to the present invention, a separate path 62 is created to couple power to manual switch 32 independent of the present state of time delay relay 38 or relays 50 and 54. If the path 62 did not exist, the only means for reestablishing the former operative condition of the system would be if all of the proximity switches 20 were in a state indicating proper positioning of spreader 10 on container 14. With relay 62, the system is returned to an operative condition regardless of the state of said sensors 20.

Once power has been reestablished, and the operative condition of the system restored, means are provided for actuating the third relay 60 and maintaining it in an actuated state, thereby eliminating the separate path 62. This means comprises a manual reset switch 64 and a set of normally open contacts controlled by third relay 60 to establish fourth separate path 66. When reset switch 64 is closed, power is coupled to third relay 60, thereby causing relay 60 to actuate. Once relay 60 is actuated, the normally open contacts of the fourth separate path 66 are closed thereby maintaining the coupling of power to third relay 60 after the reset switch 64 is released. Thus, path 66 acts to maintain third relay 60 in its actuated state, so long as a subsequent power loss is not experienced.

To provide an indication that third relay 60 is presently in an unactuated state, normally closed switch contacts of said relay 60 are positioned to create a fifth separath path 68 to bell 44 when relay 60 is unactuated. This creates an audible warning of this state of relay 60 so that an operator may then proceed to manually actuate the reset switch 64, to return the control circuit to its normal operative state.

Figure 4:
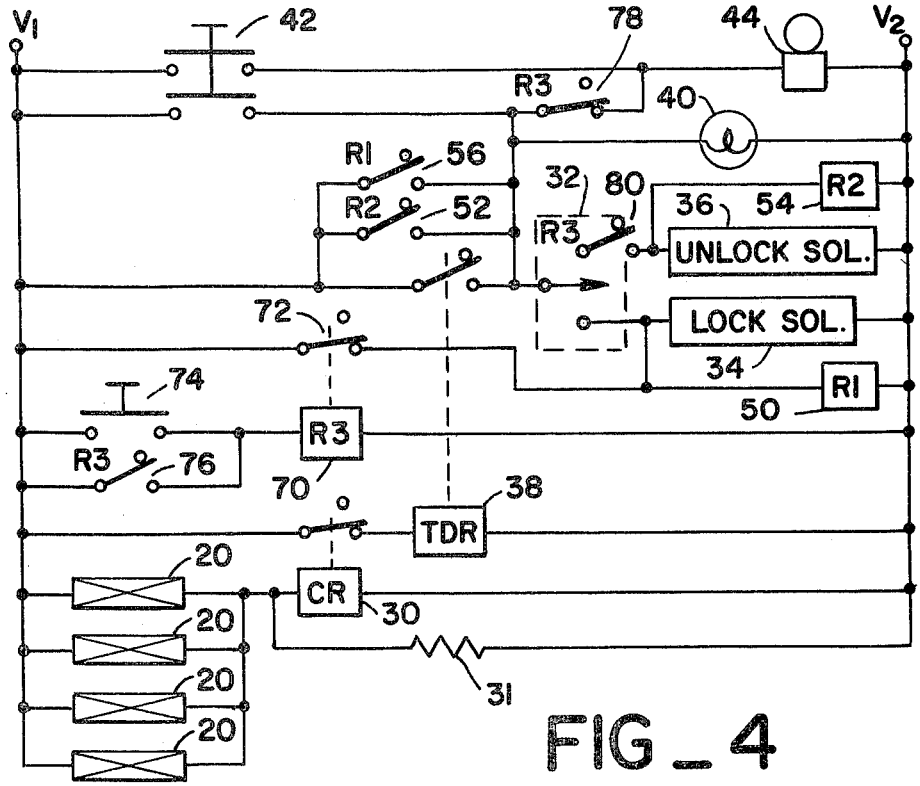
FIG. 4 is a schematic diagram of an alternate embodiment of the electrical circuit according to the present invention.

A second embodiment of a means for returning the system to an operative state even if a temporary loss of power is experienced, is illustrated in FIG. 4. This embodiment differs from the embodiment of FIG. 3 in that the third relay means R3 is designated as relay 70 and is operative to maintain a separate path 72 for coupling power only to the lock solenoid 34 and relay 50 when third relay 70 is in its unactuated state. That is, in this embodiment, rather than providing a separate path for coupling power to manual switch 32, the power is coupled directly to the lock solenoid 34 and first relay 50, to ensure that once power is restored, the control circuit is either maintained in a lock solenoid 34 actuated condition, or forced to actuate solenoid 34 to create this state. As described above, once the lock solenoid 34 is actuated, first relay 50 acts to maintain power to the manual switch 32 and indicator means 40 through separate path 56 independent of the state of proximity sensors 20.

As with the previously mentioned embodiment of FIG. 3, relay 70 is actuated by means of a reset switch 74 and maintained in its actuated condition by normally open contacts thereof which are closed to provide a separate path 76 as hereinbefore described in connection with relay 60 and path 66. Similarly, normally closed switch contacts of relay 70 are positioned to create a separate path 78 to energize an alarm warning bell 44 when third relay 70 is in its unactuated state.

However, the embodiment of FIG. 4 further differs from the embodiment of FIG. 3 in that the relay 70 includes a further set of normally open contacts connected to ensure that power cannot be applied to the unlocking solenoid 36 after a power outage, until the reset switch 74 has been manually actuated. In FIG. 4 such further set of normally open contacts identified by reference numeral 80 are interposed between the manual switch 32 and the unlocking solenoid 36. Thus, even if the manual switch 32 is in its unlock position no power can be coupled to the unlock solenoid 36 and relay 54 until reset switch 74 has been manually actuated.

Note, however, that once third relay 70 is actuated by manual actuation of the reset switch 74, power will no longer be connected through path 72 to the lock solenoid 34 and relay 50 and thus power will no longer be connected to alarm bell 44, indicator means 40 and the manual switch 32 through path 56. Thus, the locking solenoid 34 will be allowed to "float" in its actuated state unless the manual switch 32 was in its lock position when the reset switch 74 was manually actuated after a power outage.

In any event, the unlocking solenoid 36 cannot be actuated by manual switch 32 until the control relay 30 and time delay relay 38 are again actuated by the sensors 20. Any attempt to actuate the unlocking solenoid 36 without first actuating the sensors 20 will cause the locking solenoid 34 to "float" in its locked condition and will de-energize the indicator means 40.

If there is no container 14 locked to the spreader 10 when a control circuit according to the embodiment of FIG. 4 experience a power outage and is reset, with the manual switch 32 in (or subsequently moved to) its unlocking position, restoration of power to the indicator means 40 and manual switch 32 can only be obtained by use of the bypass switch 42. This is because the twist locks will be in their locking position and will prevent the spreader 10 from being properly positioned with respect to a container 14 to actuate the sensors 20 and thus the control relay 30 and time delay relay cannot be actuated to restore power to the manual switch 32 and indicator means 40.

It is to be understood that the foregoing description is illustrative of preferred embodiments of the invention, and that the scope of the invention is not to be limited thereto, but is to be determined by the scope of the appended claims.

What is claimed is:

1. In a crane system for moving a cargo container, including a spreader means adapted to be locked onto the container to be moved, said spreader means having a plurality of remotely operated locking members located substantially at the corners of said spreader means for engaging mating locking devices provided on the container, and further including proximity sensing means positioned on said spreader means for sensing when said spreader means is properly positioned with respect to the container for locking thereto, manual switching means for coupling power, when power is connected to said switching means, to either a locking solenoid or an unlocking solenoid for controlling thereby the locking or unlocking of said spreader locking members, and means responsive to said proximity sensing means for coupling power to said manual switching means when said spreader means is in its said proper position with respect to the container, the improvement comprising:

a first relay means;

means for actuating and maintaining said first relay means in an actuated state so long as said manual switching means couples power to said locking solenoid, said first relay means in said actuated state acting to create a first separate path for coupling power to said manual switching means whereby coupling of power is maintained to said manual switching means independent of the subsequent state of said proximity sensing means.

2. The improvement of claim 1 further comprising:

a second relay means; and means for actuating and maintaining said second relay means in an actuated state so long as said manual switching means couples power to said unlocking solenoid, said second relay means in said actuated state acting to create a second separate path for coupling power to said manual switching means whereby coupling of power is maintained to said manual switching means independent of the subsequent state of said proximity sensing means.

3. The improvement of claim 1 or 2 further comprising:

a third relay means operative to maintain a third separate path for coupling power to said manual switching means when said third relay means is in its unactuated state; and means for actuating and maintaining said third relay means in an actuated state, thereby eliminating said third separate path, so long as power is maintained to said system.

4. The improvement of claim 3 wherein said means for activating and maintaining said third relay means in an actuated state comprises:

manual reset switch means for coupling power to said third relay means when said reset switch means is manually closed, said third relay means, when actuated thereby, acting to create a fourth separate path for coupling of power to said third relay means, to maintain said third relay means in its said actuated state.

5. The improvement of claim 1 or 2 further comprising:

a third relay means operative to maintain a third separate path for coupling power to said locking solenoid when said third relay means is in its unactuated state; and means for actuating and maintaining said third relay means in an actuated state, thereby eliminating said third separate path, so long as power is maintained to said system.

6. The improvement of claim 5 wherein said means for actuating and maintaining said third relay means in an actuated state comprises:

manual reset switch means for coupling power to said third relay means when said relay switch means is manually closed, said third relay means, when actuated thereby, acting to create a fourth separate path for coupling of power to said third relay means, to maintain said third relay means in its said actuated state.

7. In a crane system for moving a cargo container, including a spreader means adapted to be positioned on top of a container to be moved, said spreader means having four remotely operated locking members located substantially at the corners of said spreader means for engaging mating locking devices provided at the top of the container, and further including non-contacting proximity sensor means positioned on said spreader means, including a plurality of proximity sensors connected in parallel, each positioned at respective corners of said spreader means, and operative to output an electrical signal once said spreader means is detected by all said sensors to be properly positioned with respect to the container for locking thereto, manual switching means for coupling power, when power is connected to said switching means to either a locking solenoid or an unlocking solenoid for controlling thereby the locking or unlocking of said spreader locking members, and means responsive to said proximity sensing means for coupling power to said manual switching means when said spreader means is in its said proper position with respect to the container, said manual switching means including delay means for delaying coupling of power to said manual switching means when said spreader means is initially detected to be properly positioned on said container, the improvement comprising:

a first relay means;

means for actuating and maintaining said first relay means in an actuated state so long as said manual switch means couples power to said locking solenoid, said first relay means in said actuated state acting to create a first separate path for coupling power to said manual switching means whereby coupling of power is maintained to said manual switching means independent of the subsequent state of said proximity sensors;

a second relay means;

means for actuating and maintaining said second relay means in an actuated state so long as said manual switching means couples power to said unlocking solenoid, said second relay means in said actuated state acting to create a second separate path for coupling power to said manual switching means whereby coupling of power is maintained to said manual switching means independent of the subsequent state of said proximity sensing means;

a third relay means operative to maintain a third separate path for coupling power to said manual switching means when said third relay means is in its unactuated state; and means for actuating and maintaining said third relay means in an actuated state, thereby eliminating said third separate path, so long as power is maintained to said system, said means including manual reset switch means for coupling power to said third relay means when said reset switch means is manually closed, said third relay means, when actuated thereby, acting to create a fourth separate path for coupling of power to said third relay means, to maintain said third relay means in its said actuated state.

8. The improvement of claim 7 further comprising:

first indicating means for indicating when power is being coupled to said manual switching means; and second indicating means for indicating when said third relay is in its said unactuated state.

9. The improvement of claim 7 further comprising:

manual bypass switch means for manually enabling the coupling of power to said manual switching means; and means for indicating the actuation of said manual bypass switch means.

10. In a crane system for moving a cargo container, including a spreader means adapted to be positioned on a container to be moved, said spreader means having four remotely operated locking members located substantially at the corners of said spreader means for engaging mating locking devices provided on the container, and further including non-contacting proximity sensor means positioned on said spreader means, including a plurality of proximity sensors connected in parallel, each positioned at respective corners of said spreader means, and operative to output an electrical signal once said spreader means is detected by all said sensors to be properly positioned with respect to the container for locking thereto, manual switching means for coupling power, when power is connected to said switching means to either a locking solenoid or an unlocking solenoid for controlling thereby the locking or unlocking of said spreader locking members, and control relay means responsive to said electric signal of said proximity sensor means for coupling power to said manual switching means when said spreader means is in its said proper position with respect to the container, said control relay means including delaying means for delaying coupling of power to said manual switching means when said spreader means is initially detected to be properly positioned on said container, the improvement comprising:

a first relay means;

means for actuating and maintaining said first relay means in an actuated state so long as said manual switch means couples power to said locking solenoid, said first relay means in said actuated state acting to create a first separate path for coupling power to said manual switching means whereby coupling of power is maintained to said manual switching means independent of the subsequent state of said proximity sensor means and said control relay means;

a second relay means;

means for actuating and maintaining said second relay means in an actuated state so long as said manual switching means couples power to said unlocking solenoid, said second relay means in said actuated state acting to create a second separate path for coupling power to said manual switching means whereby coupling of power is maintained to said manual switching means independent of the subsequent state of said proximity sensor means and said control relay means;

a third relay means operative to maintain a third separate path for coupling power to said locking solenoid when said third relay means is in its unactuated state; and means for actuating and maintaining said third relay means in an actuated state, thereby eliminating said third separate path, so long as power is maintained to said system, said means including manual reset switch means for coupling power to said third relay means when said reset switch means is manually closed, said third relay means, when actuated thereby, acting to create a fourth separate path for coupling of power to said third relay means, to maintain said third relay means in its said actuated state.

* * * * *